US010405617B2

(12) United States Patent
Hung

(10) Patent No.: US 10,405,617 B2
(45) Date of Patent: Sep. 10, 2019

(54) BRACELET ASSEMBLY

(71) Applicant: Yun-Tung Hung, Taipei (TW)

(72) Inventor: Yun-Tung Hung, Taipei (TW)

( * ) Notice: Subject to any disclaimer, the term of this patent is extended or adjusted under 35 U.S.C. 154(b) by 135 days.

(21) Appl. No.: 15/837,191

(22) Filed: Dec. 11, 2017

(65) Prior Publication Data

US 2019/0174881 A1 Jun. 13, 2019

(51) Int. Cl.
*A44C 5/00* (2006.01)
*A44C 15/00* (2006.01)

(52) U.S. Cl.
CPC ..... *A44C 5/0015* (2013.01); *A44C 5/0023* (2013.01); *A44C 15/0015* (2013.01)

(58) Field of Classification Search
CPC ..... A44C 5/12; A44C 5/102; A44C 5/0015; A44C 5/0023
USPC ..... 63/3.1, 15.7; 24/574.1
See application file for complete search history.

(56) References Cited

U.S. PATENT DOCUMENTS 241,453 A * 5/1881 Untermeyer ..... A44C 17/0208 63/29.1
401,746 A * 4/1889 Johnstone ..... A44C 5/0092 63/1.12
1,558,418 A * 10/1925 Wendel ..... A44C 9/02 29/896.412
2,146,272 A * 2/1939 Skoog ..... A44C 9/02 63/15.65
D247,482 S * 3/1978 Schupp ..... D11/4
4,974,429 A * 12/1990 Ferrara ..... A44C 15/001 428/10
D472,177 S * 3/2003 McCullough-McPherson ..... D11/4
8,701,438 B1 * 4/2014 Kovel ..... A44C 5/0053 63/11

* cited by examiner

*Primary Examiner* — Abigail E Troy
(74) *Attorney, Agent, or Firm* — C. G. Mersereau; DeWitt LLP

(57) ABSTRACT

A bracelet assembly includes a base and a module part. The module part is replaceably connected to the base by connection between a first engaging member of the module part and a notch of the base, and by connection between a second engaging member of the module part and a hole of the base. The module part of different functions can be replaced so as to need different needs.

9 Claims, 10 Drawing Sheets

BRACELET ASSEMBLY

BACKGROUND OF THE INVENTION

1. Fields of the Invention

The present invention relates to a bracelet assembly, and more particularly, to a multi-function bracelet with a replaceable module part.

2. Descriptions of Related Art

The conventional bracelets are mostly designed for fashion purposes and may use different types of metals or include jewelry attached thereon. Recently, the bracelets are designed to detect or monitor the health conditions of the wearers who can check the physiological data from the bracelets. However, what the wearers want from the bracelets not just being able to monitor the physiological conditions, the wearers also want to wear a bracelet with decorative features. The expenses will be very high if he or she purchase many bracelets for different features or purposes.

The present invention intends to provide a multi-function bracelet with a replaceable module part which can be replaceable as needed.

SUMMARY OF THE INVENTION

The present invention relates to a bracelet assembly and comprises a base having two distal ends, wherein one of the two distal ends of the base has a reception portion and at least one notch which is located next to the reception portion, and the other one of the two distal ends of the base has at least one hole.

A module part is replaceably connected to the base and has two ends. One of the two ends of the module part has an extension portion which is engaged with the reception portion, and the extension portion has a first engaging member which is engaged with the notch. The other one of the two ends has a second engaging member which is engaged with the at least one hole. The first engaging member and the second engaging member respectively face two opposite directions.

Preferably, the module part is one of an electronic device, a piece of jewelry, a cosmetic product or a perfume box.

Preferably, the electronic device is a calculator, a pedometer, a timer, a calorie calculator, a physiological monitor, a clock, a positioning device, an audio/video recording device, an alarm pager, a video communication device, an LED unit, a an audio/video playing device, a voice translation device, a camera or an electronic ticketing device wirelessly connected with a phone.

Preferably, the base is a round, rectangular, oval or polygonal base.

Preferably, the bracelet assembly is made of gold, platinum, silver, palladium, tungsten carbide, cobalt, tantalum, copper, stainless steel, plastic or wood.

Preferably, a first protrusion is located between the reception portion and the notch. The extension portion has a recessed area with which the first protrusion is engaged so that the first engaging member is engaged with the at least one notch.

Preferably, a second protrusion is located at the distal edge of the reception portion. A recess is defined in the backside of the recessed area, and the second protrusion is engaged with the recess, when the extension portion is engaged with the reception portion. The second engaging member is engaged with the hole to connect the module part to the base.

Preferably, the first engaging member and the second engaging member each are a block.

Preferably, the base is connected to the module part to form an enclosed bracelet assembly which can be worn to a user's wrist.

The primary object of the present invention is to provide a bracelet assembly, wherein the module part of different functions can be replaced so as to need different needs. The replacement is easy and friendly used by the users of different ages. The bracelet assembly may be made of different types of material and have different functions.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
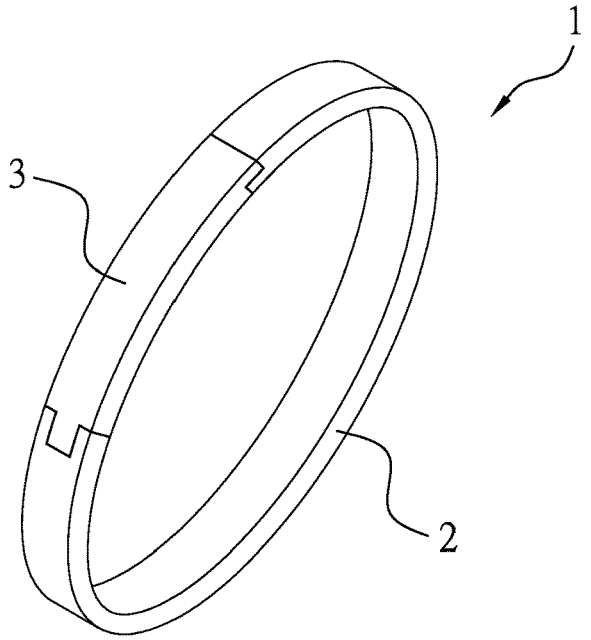
FIG. 1 is a perspective view to show the bracelet assembly of the present invention.
Figure 2:
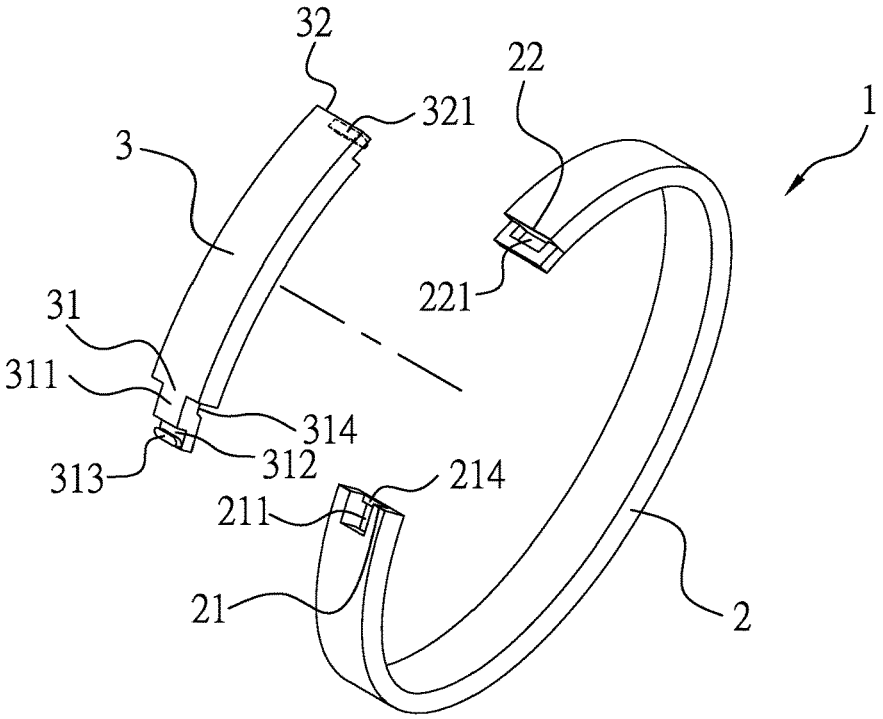
FIG. 2 is an exploded view of the bracelet assembly of the present invention.

Referring to FIGS. 1 to 10, the bracelet assembly 1 of the present invention comprises a bracelet assembly 1 and comprises a base 2 having two distal ends 21, 22. One of the two distal ends 21 of the base 2 has at least one reception portion 211 and a notch 212 which is located next to the reception portion 211. The other one of the two distal ends 22 of the base 2 has a hole 221. The base 2 is a round, rectangular, oval or polygonal base.

A module part 3 is replaceably connected to the base 2 and has two ends 31, 32. One of the two ends 31 of the module part 3 has an extension portion 311 which is able to extend and engage with the reception portion 211. The extension portion 311 has a first engaging member 313 which is engaged with the notch 212. In this embodiment, the first engaging member 313 is a block which is not limited thereto. The other one of the two ends 32 has a second engaging member 321 which is engaged with the hole 221. In this embodiment, the second engaging member 321 is a block which is not limited thereto. The first engaging member 313 and the second engaging member 321 respectively face two opposite directions. By extending the extension portion 311 through the reception portion 211, the first engaging member 313 is engaged with the notch 212, and the second engaging member 321 is engaged with the hole 221 of the base 2, so that the module part 3 is connected to the base 2. The bracelet assembly 1 is made of gold, platinum, silver, palladium, tungsten carbide, cobalt, tantalum, copper, stainless steel, plastic or wood, but not limited thereto.

A first protrusion 213 is located between the reception portion 211 and the notch 212. The extension portion 311 has a recessed area 312 with which the first protrusion 213 is engaged so that the first engaging member 313 is engaged with the notch 212. A second protrusion 214 is located at the distal edge of the reception portion 211. A recess 314 is defined in the backside of the recessed area 312, and the second protrusion 214 is engaged with the recess 314, when the extension portion 311 is engaged with the reception portion 211. The other end 32 of the module part 3 can be moved downward. The second engaging member 321 is engaged with the hole 221 to connect the module part 3 to the base 2.

Figure 3:
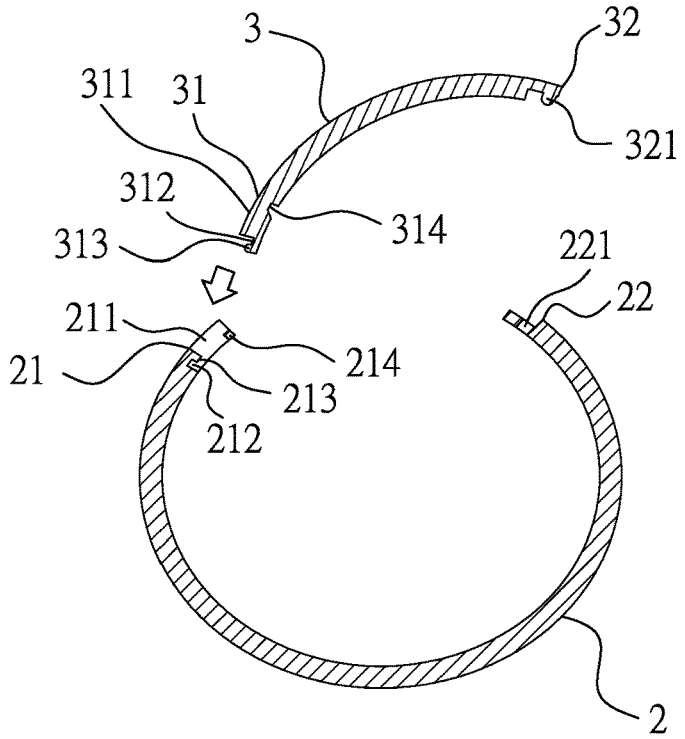
FIGS. 3 to 5 are cross sectional views to show the steps for connecting the module part to the base of the bracelet assembly of the present invention.
Figure 4:
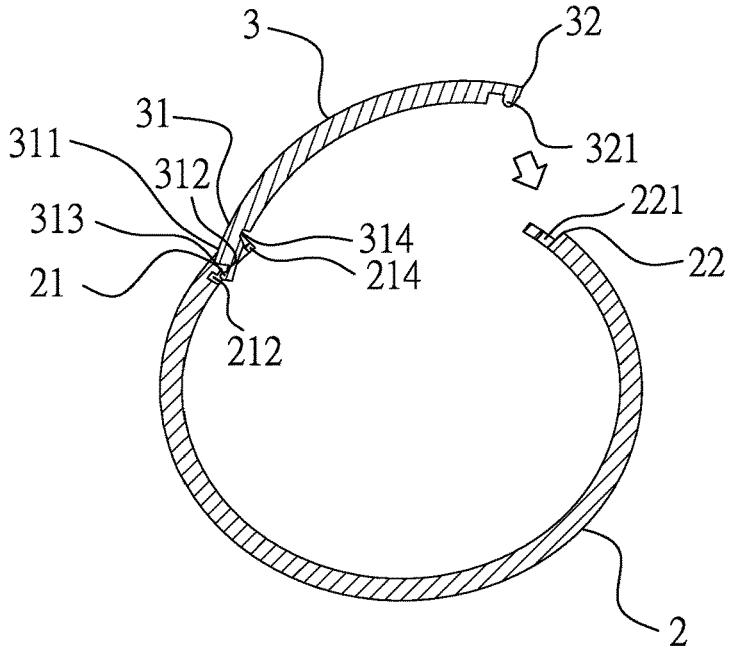
Figure 5:
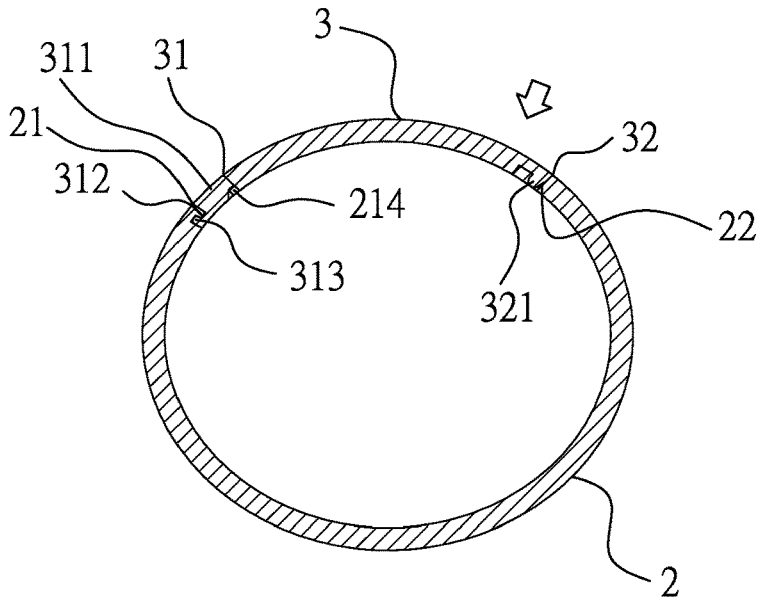

The base 2 is connected to the module part 3 to form an enclosed bracelet assembly 1 which can be worn to a user's wrist. When in assembling, the extension portion 311 extends through the reception portion 211, as shown in FIG. 3, and the first engaging member 313 of the module part 3 is engaged with the notch 212 of the base 2. The first protrusion 213 is located corresponding to the recessed area 312, and the second protrusion 214 is engaged with the recess 314 as shown in FIG. 4. The end 32 of the module part 3 is then moved toward the base 2 to engage the second engaging member 321 with the hole 221 to connect the module part 3 to the base 2 as shown in FIG. 5.

Figure 6:
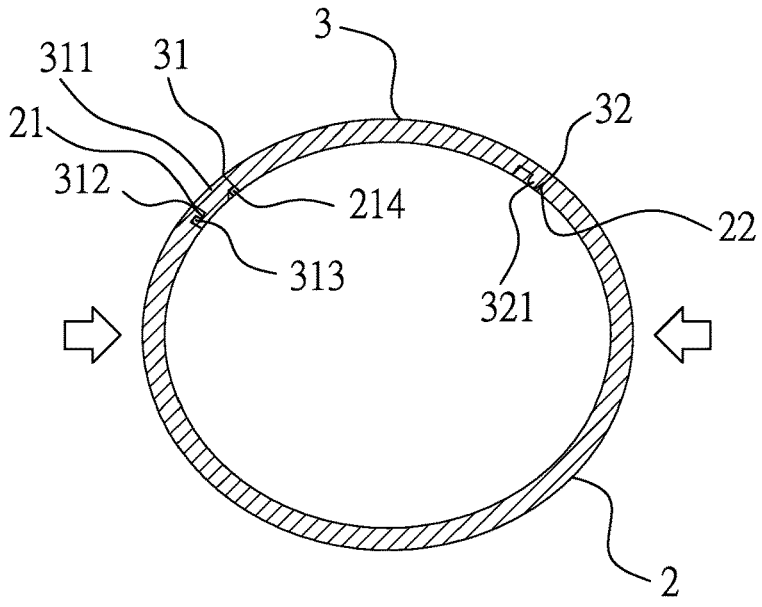
FIGS. 6 and 7 are cross sectional views to show the steps for dis-connecting the module part from the base of the bracelet assembly of the present invention.
Figure 7:
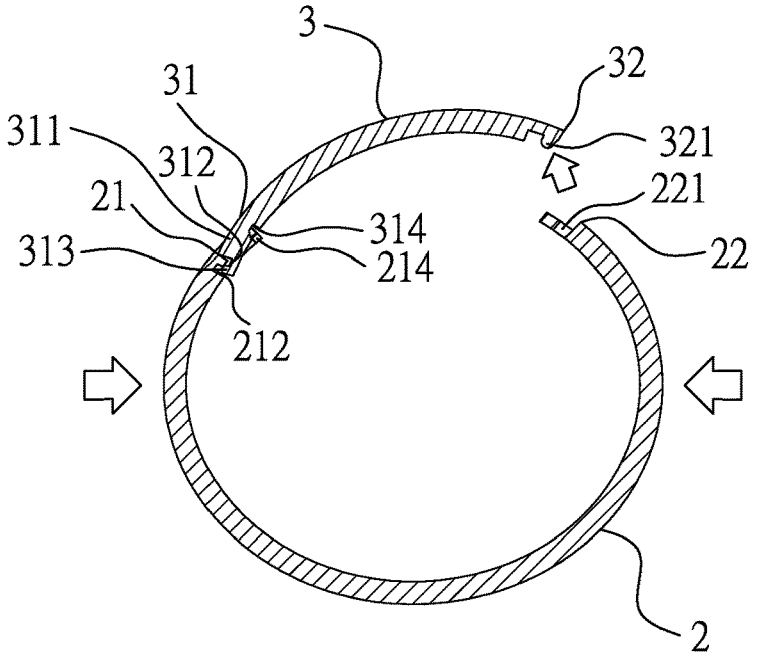

When replacing the module part 3, as shown in FIG. 6, the base 2 is squeezed from two sides thereof to slightly deform the base 2, so that the second engaging member 321 of the module part 3 is disengaged from the hole 221 of the base 2. Then the first engaging member 313 of the module part 3 is disengaged from the notch 212 of the base 2 as shown in FIG. 7. The module part 3 is then removed from the base 2. A new module part 3 can be connected to the base 2.

Figure 8:
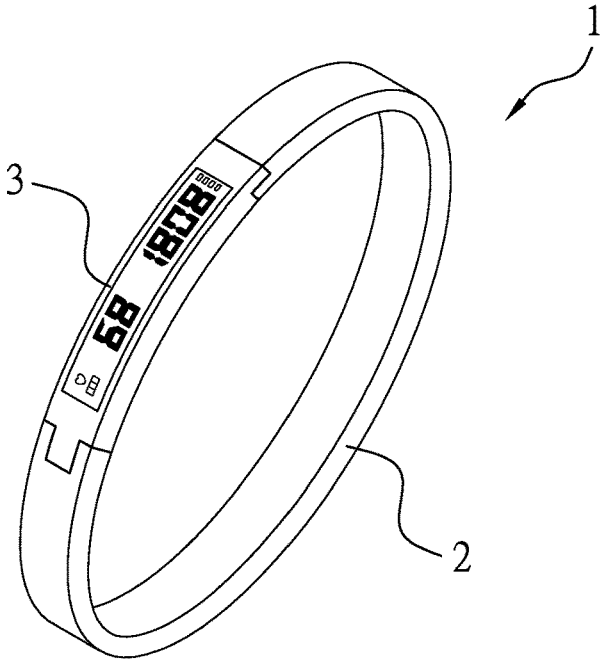
FIGS. 8 to 10 show that the module part of different functions is connected to the base of the bracelet assembly of the present invention.
Figure 9:
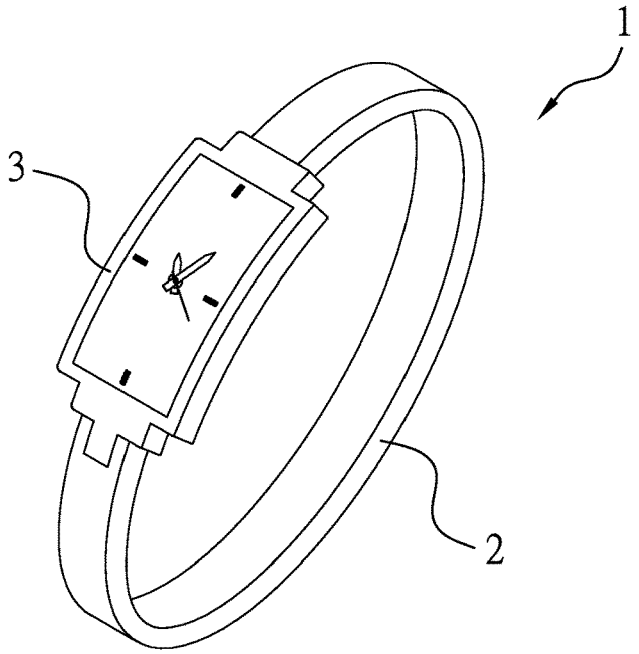
Figure 10:
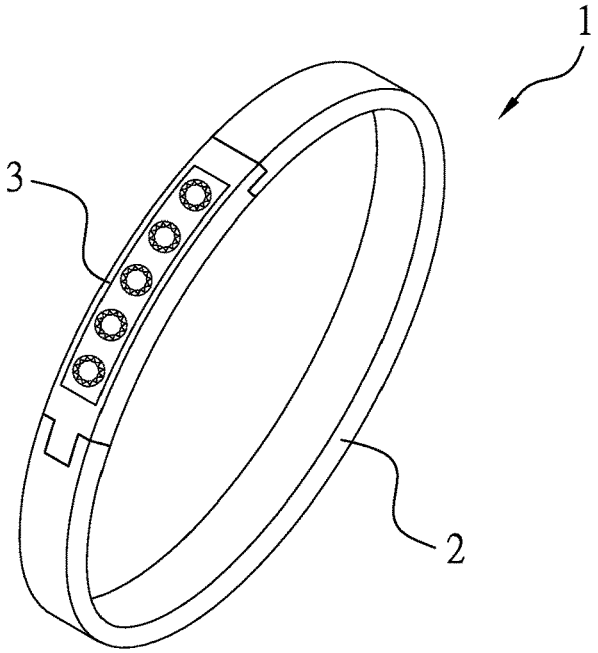

The module part 3 may have different functions, as shown in FIGS. 8 and 9, the module part 3 can be an electronic device which is a calculator, a pedometer, a timer, a calorie calculator, a physiological monitor, a clock, a positioning device, an audio/video recording device, an alarm pager, a video communication device, an LED unit, a an audio/video playing device, a voice translation device, a camera or an electronic ticketing device wirelessly connected with a phone. As shown in FIG. 10, the module part 3 can be a piece of jewelry, a cosmetic product or a perfume box. The users can choose a specific module part 3 to wear according to needs. Because the module part 3 is replaceable, so that the bracelet assembly 1 involves different functions.

Figure 11:
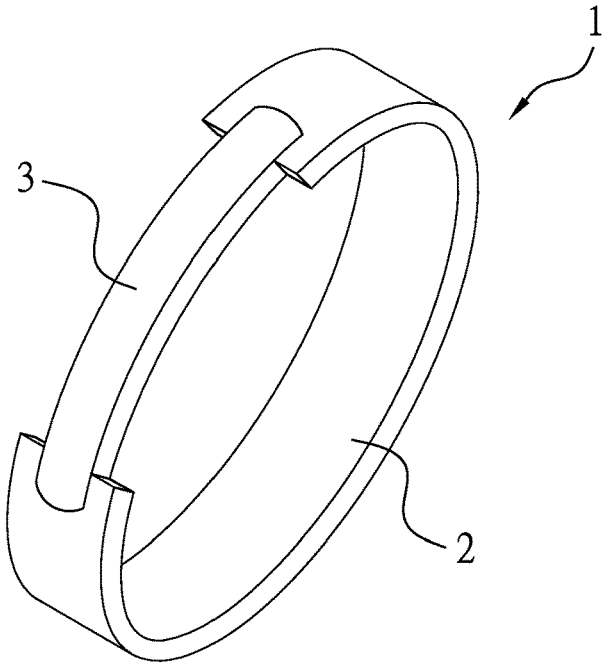
FIG. 11 is a perspective view to show one preferable embodiment of the base of the bracelet assembly of the present invention.
Figure 12:
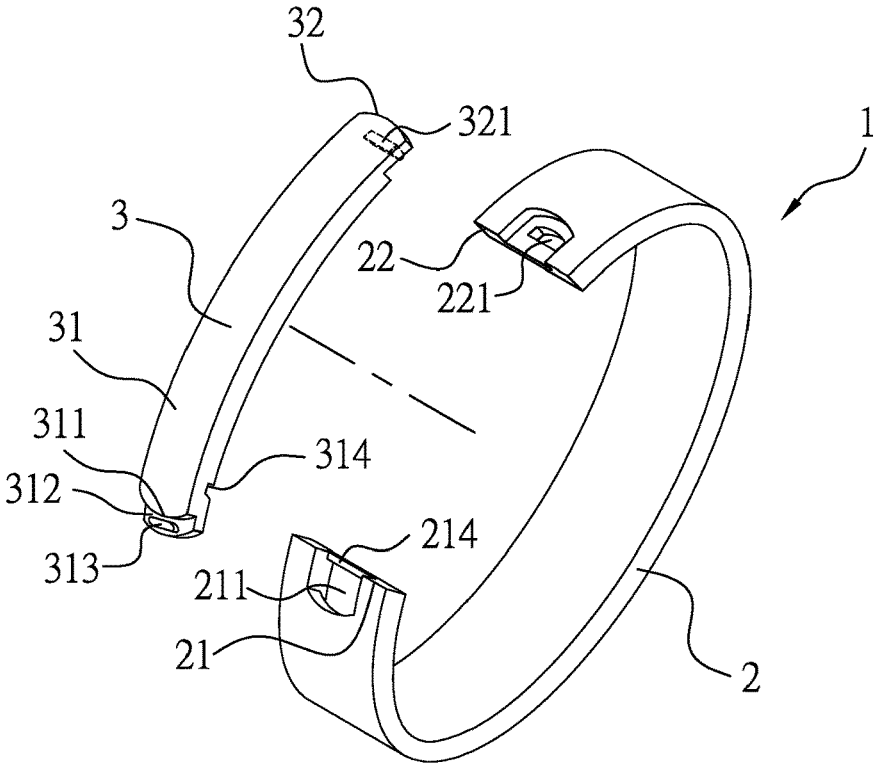
FIG. 12 is an exploded view to show the preferable embodiment shown in FIG. 11.

As shown in FIGS. 11 and 12, the size and shape of the base 2 and the module part 3 may be varied, wherein the width of the base 2 is slightly wider than the module part 3. The reception portion 211 and the hole 221 of the base 2 has a rounded inside. The two ends 31, 32 and the extension portion 311 of the module part 3 includes a rounded end which is matched with the rounded inside of the reception portion 211 and the hole 221 of the base 2.

Figure 13:
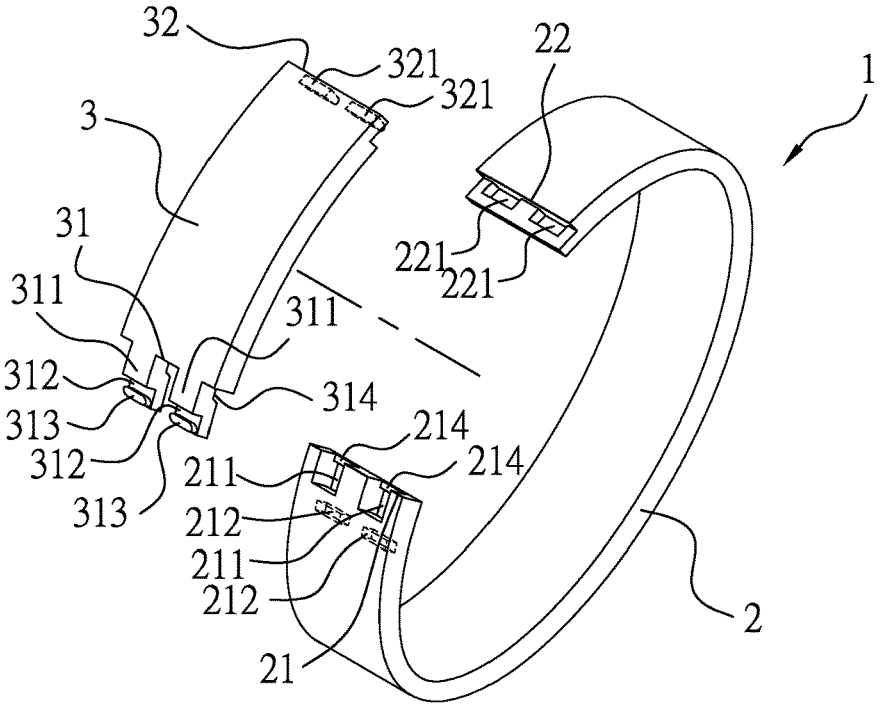
FIG. 13 is an exploded view to show one preferable embodiment of the base of the bracelet assembly of the present invention.
Figure 14:
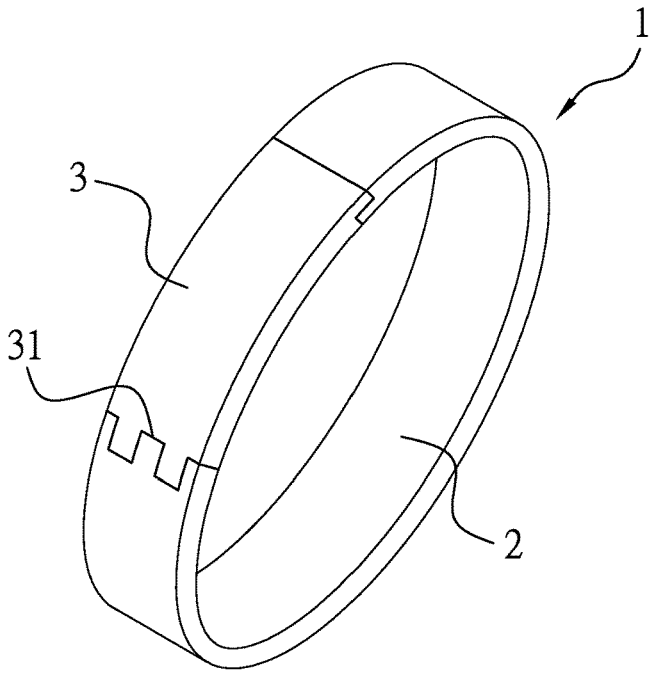
FIG. 14 is a perspective view to show the preferable embodiment shown in FIG. 13.
Figure 15:
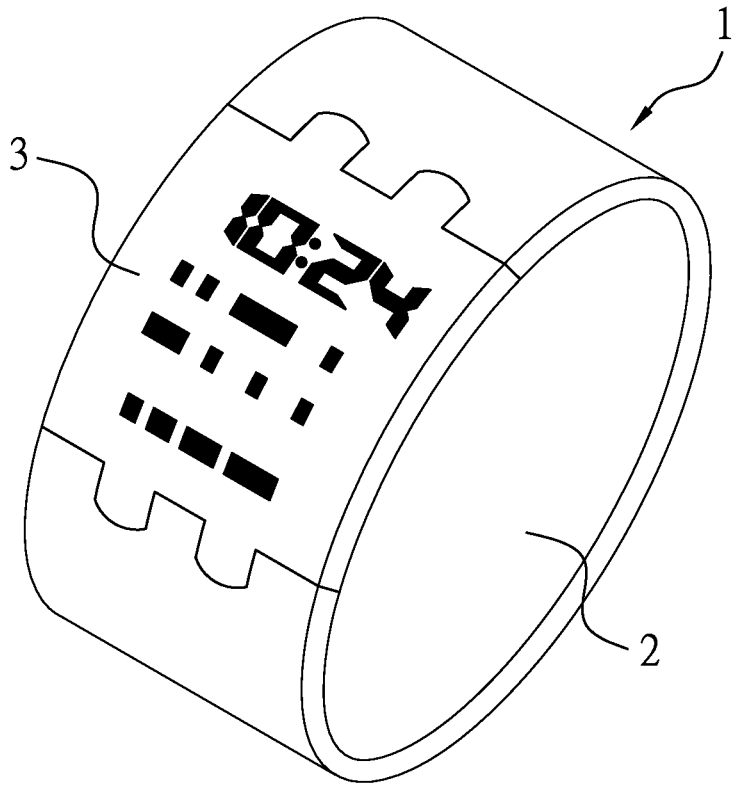
FIG. 15 is a perspective view to show one preferable embodiment of the base of the bracelet assembly of the present invention.

As shown in FIGS. 13 and 14, the base 2 has multiple reception portions 211, and the notch 212 is locate next to each reception portion 211. There are multiple holes 221. The module part 3 includes multiple first engaging members 313 on the end 31 thereof, and multiple second engaging members 321 on the other end 32 of the module part 3. The installation and removal steps are the same as previous embodiment. The module part 3 is replaceable relative to the base 2 and has different functions. As shown in FIG. 15, the module part 3 is a digital clock which is not limited thereto.

Figure 16:
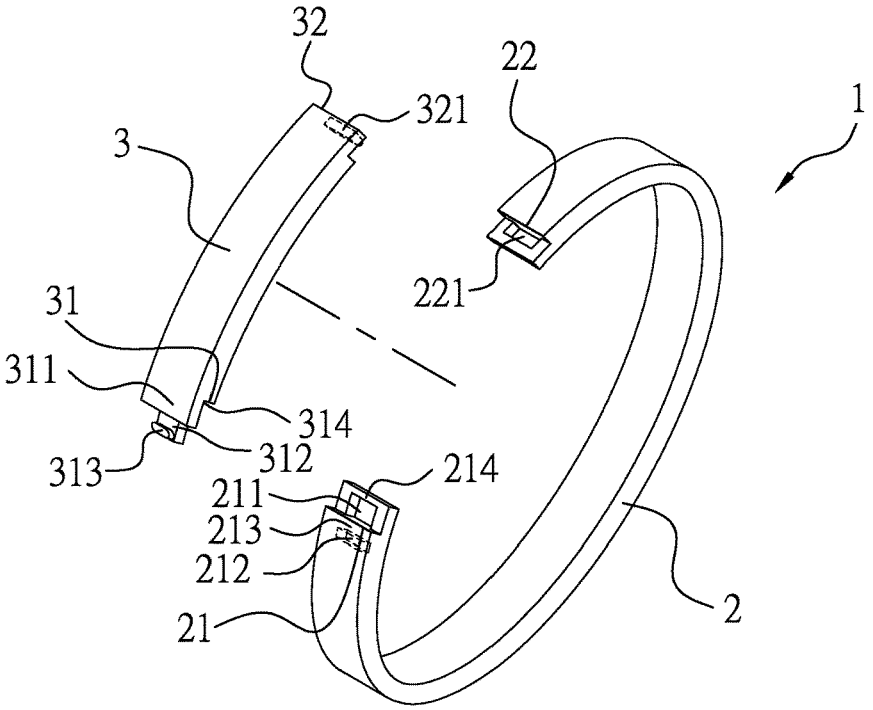
FIG. 16 is an exploded view to show one preferable embodiment of the base of the bracelet assembly of the present invention.
Figure 17:
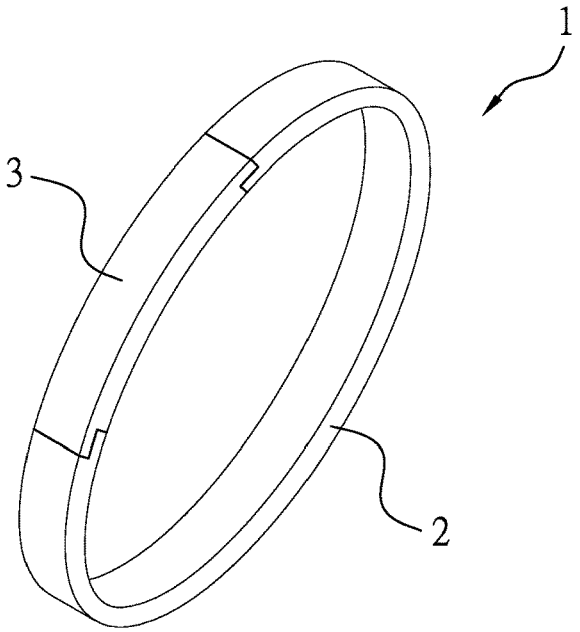
FIG. 17 is a perspective view to show the preferable embodiment shown in FIG. 16.

As shown in FIGS. 16 and 17, the extension portion 311 extends from the underside of the end 31 of the module part 3. The extension portion 311 has the first engaging member 313 to be engaged with the notch 212. The base 2 includes two distal ends 21, 22. has at least one reception portion 211 defined in the distal end 21 thereof, and the notch 212 is located next to the reception portion 211. The other distal end 22 of the base 2 includes the hole 221. The first protrusion 213 is located between the reception portion 211 and the notch 212. The extension portion 311 has the recessed area 312 with which the first protrusion 213 is engaged so that the first engaging member 313 is engaged with the notch 212. The second protrusion 214 is located at the distal edge of the reception portion 211. The recess 314 is defined in the backside of the recessed area 312, and the second protrusion 214 is engaged with the recess 314 when the extension portion 311 is engaged with the reception portion 211. The other end 32 of the module part 3 can be moved downward. The second engaging member 321 is engaged with the hole 221 to connect the module part 3 to the base 2.

Figure 18:
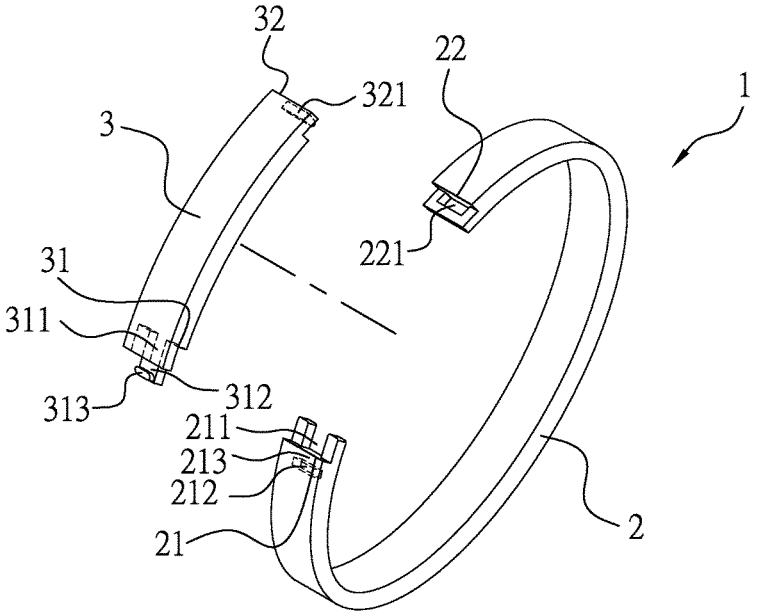
FIG. 18 is an exploded view to show one preferable embodiment of the base of the bracelet assembly of the present invention.
Figure 19:
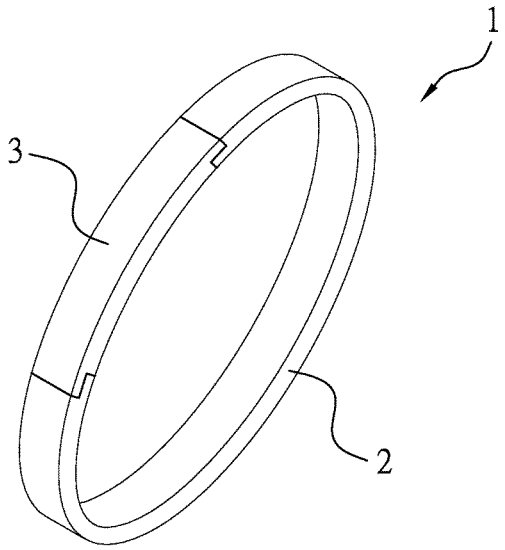
FIG. 19 is a perspective view to show the preferable embodiment shown in FIG. 18.

As shown in FIGS. 18 and 19, the extension portion 311 extends from the underside of the module part 3. The extension portion 311 has the first engaging member 313 to be engaged with the notch 212. The difference between the FIGS. 16 and 17 is that the reception portion 211 does not have the second protrusion 214 at the distal edge of the reception portion 211. There is no such recess 314 defined in the backside of the recessed area 312. When the extension portion 311 extends through the reception portion 211, the end 32 of the module part 3 is directly moved toward the base 2 to engage the second engaging member 321 with the hole 221 to connect the module part 3 to the base 2.

The present invention includes the following advantages when comparted with the conventional bracelets, the advantages are that the module part 3 and the base 2 are specifically structured so that the module part 3 of specific function can be replaceable relative to the base 2 easily. The bracelet assembly 1 of the present invention can be used by users of different ages. The bracelet assembly 1 can be made by different types of material to meet specific purposes.

While we have shown and described the embodiment in accordance with the present invention, it should be clear to those skilled in the art that further embodiments may be made without departing from the scope of the present invention.

What is claimed is:

1. A bracelet assembly comprising:

a base having two distal ends, one of the two distal ends of the base having at least one reception portion and at least one notch which is located next to the at least one reception portion, the other one of the two distal ends of the base having at least one hole, and a module part replaceably connected to the base and having two ends, one of the two ends of the module part having at least one extension portion which extends through and is engaged with the at least one reception portion, the at least one extension portion having at least one first engaging member which is engaged with the at least one notch, the other one of the two ends having at least one second engaging member which is engaged with the at least one hole, the at least one first engaging member and the at least one second engaging member respectively facing two opposite directions.

2. The bracelet assembly as claimed in claim 1, wherein the module part is one of an electronic device, a piece of jewelry, a cosmetic product or a perfume box.

3. The bracelet assembly as claimed in claim 2, wherein the electronic device is a calculator, a pedometer, a timer, a calorie calculator, a physiological monitor, a clock, a positioning device, an audio/video recording device, an alarm pager, a video communication device, an LED unit, a an audio/video playing device, a voice translation device, a camera or an electronic ticketing device wirelessly connected with a phone.

4. The bracelet assembly as claimed in claim 1, wherein the base is a round, rectangular, oval or polygonal base.

5. The bracelet assembly as claimed in claim 1, wherein the bracelet assembly is made of gold, platinum, silver, palladium, tungsten carbide, cobalt, tantalum, copper, stainless steel, plastic or wood.

6. The bracelet assembly as claimed in claim 1, wherein a first protrusion is located between the at least one reception portion and the at least one notch, the at least one extension portion has a recessed area with which the first protrusion is engaged so that the at least one first engaging member is engaged with the at least one notch.

7. The bracelet assembly as claimed in claim 6, wherein a second protrusion is located at a distal edge of the at least one reception portion, a recess is defined in a backside of the recessed area and the second protrusion is engaged with the recess, when the at least one extension portion is engaged with the at least one reception portion, the at least one second engaging member is engaged with the at least one hole to connect the module part to the base.

8. The bracelet assembly as claimed in claim 1, wherein the at least one first engaging member and the at least one second engaging member each are a block.

9. The bracelet assembly as claimed in claim 1, wherein the base is connected to the module part to form the bracelet assembly which is adapted to be worn on a user's wrist.

* * * * *